US006016791A

United States Patent [19]

Thomas et al.

[11] Patent Number: 6,016,791

[45] Date of Patent: Jan. 25, 2000

[54] METHOD AND SYSTEM FOR CONTROLLING FUEL PRESSURE IN A COMMON RAIL FUEL INJECTION SYSTEM

[75] Inventors: Eric D. Thomas, Canton; S. Miller Weisman, II, Farmington Hills, both of Mich.

[73] Assignee: Detroit Diesel Corporation, Detroit, Mich.

[21] Appl. No.: 08/867,695

[22] Filed: Jun. 4, 1997

[51] Int. Cl.[7] ..... F02M 37/04

[52] U.S. Cl. ..... 123/497; 123/456

[58] Field of Search ..... 123/497, 357, 123/447, 456

[56] References Cited

U.S. PATENT DOCUMENTS

| | | | |
|---|---|---|---|
| 4,217,862 | 8/1980 | Fort et al. . | |
| 4,917,063 | 4/1990 | Hiraki | 123/357 |
| 5,058,553 | 10/1991 | Kondo et al. . | |
| 5,133,645 | 7/1992 | Crowley et al. . | |
| 5,197,438 | 3/1993 | Yamamoto | 123/456 |
| 5,201,294 | 4/1993 | Osuka | 123/456 |
| 5,230,613 | 7/1993 | Hilsbos et al. . | |
| 5,277,156 | 1/1994 | Osuka et al. . | |
| 5,313,924 | 5/1994 | Regueiro . | |
| 5,445,128 | 8/1995 | Letang et al. . | |
| 5,477,827 | 12/1995 | Weisman, II et al. . | |
| 5,483,927 | 1/1996 | Letang et al. . | |
| 5,485,820 | 1/1996 | Iwaszkiewicz . | |
| 5,492,099 | 2/1996 | Maddock . | |
| 5,507,266 | 4/1996 | Wright | 123/456 |
| 5,605,134 | 2/1997 | Martin . | |
| 5,615,654 | 4/1997 | Weisman, II | 123/436 |
| 5,694,902 | 12/1997 | Miwa | 123/497 |

*Primary Examiner*—Carl S. Miller
*Attorney, Agent, or Firm*—Brooks & Kushman P.C.

[57] ABSTRACT

A system and method for controlling the fuel pressure in a common rail fuel injection system which electronically controls a variable output high pressure pump based upon engine speed, torque and actual common rail pressure inputs, as well as the present system voltage, thereby providing simple yet stable control of the fuel pressure in the accumulator of the common rail system which is relatively insensitive to supply voltage fluctuations from the power source providing the electrical power to the solenoid-controlled valve which controls the high pressure pump.

18 Claims, 5 Drawing Sheets

METHOD AND SYSTEM FOR CONTROLLING FUEL PRESSURE IN A COMMON RAIL FUEL INJECTION SYSTEM

TECHNICAL FIELD

The present invention relates to a method and system for controlling the fuel pressure in a common rail fuel injection system for an internal combustion engine.

BACKGROUND ART

Common rail fuel injection systems for engines, particularly diesel engines, typically include at least one high pressure fuel pump, a plurality of fuel injectors, and at least one rail (or accumulator) connected between the fuel pump and the nozzles to accumulate fuel at a desired, relatively high pressure from the pump for injection by the injectors.

It is also known to utilize electronic control units to control and monitor various functions of the engine and its associated systems, including controlling fuel injectors. One such method and apparatus for comprehensive integrated engine control is disclosed in U.S. Pat. No. 5,445,128, issued Aug. 29, 1995 to Letang et al for "Method For Engine Control" and assigned to Detroit Diesel Corporation, assignee of the present invention.

It is desirable to have an electronic fuel pressure control system which is integrated with a comprehensive electronic engine control unit to eliminate duplication of control hardware, as well as to maximize the efficiency of the entire controlled system.

It is also desirable to employ a fuel pressure control method which provides closed-looped control of the fuel pressure in a common rail system, with limited inputs from other sensors, subsystem controls, or from other functional portions of the comprehensive integrated control system.

It is further desirable to employ a control system and method for obtaining and maintaining selected fuel pressures within a common rail fuel injection system which is relatively insensitive to supply voltage fluctuations in the electrical system.

SUMMARY OF THE INVENTION

It is therefore one object of the present invention to provide a control system and method which may be implemented as part of a comprehensive integrated electronic engine control unit to control and monitor the fuel pressure in a common rail fuel injection system.

It is another object of the present invention to provide a system and method for controlling and maintaining fuel delivery pressure within a common rail fuel injection system which electronically controls a variable output high pressure pump based upon engine speed (RPM), torque (TRQ) and actual common rail pressure ($PR_{ACT}$) inputs.

It is yet another object of the present invention to provide a simple yet stable control of the fuel pressure within a common rail system in which the ongoing control of the output of the high pressure pump, and, therefore, the pressure in the common rail, is relatively insensitive to supply voltage fluctuations from the power source providing the electrical power to the solenoid-controlled valve which controls the pump.

Carrying out the above object and other objects and features of the present invention, a method and system is provided for controlling and maintaining the fuel pressure in a common rail fuel injection system including an electronic control unit in communication with a pressure sensor, as well as other sensed and/or calculated operating parameters, input from sensors and/or the engine controller, and the logic which is executed to operate a variable output high pressure pump to establish and/or maintain a selected fuel pressure in the accumulator. The system preferably includes a variable displacement fuel pump including a solenoid-actuated fuel inlet control valve wherein the solenoid is actuated via a pulse width modulated signal. In one embodiment, the magnitude of the pulse width modulated signal is inversely proportional to the control valve opening and, thus, the output of the pump is inversely proportional to the magnitude of the control signal.

The control system also preferably includes logic for periodically determining a pressure deviation ($PR_{ERR}$) based upon engine operating condition inputs provided by the engine control, as well as from actual rail pressure input from a sensor mounted on the common rail. In one embodiment, the pressure deviation is the difference between the desired rail pressure ($PR_{DES}$, determined from speed and torque inputs) and the actual rail pressure, $PR_{ACT}$.

In one embodiment, the control includes a Pressure Commander with logic for determining the pressure deviation $PR_{ERR}$ based upon actual engine speed ($RPM_{ACT}$), engine torque (TRQ) and rail pressure ($PR_{ACT}$), a Pump Usage Governor including logic for determining a pump utilization percentage (PU%) as a function of the pressure deviation, and a Pump Control Signal Generator (PCSG) including logic for determining a pulse width modulated duty cycle percentage (DC%) control signal based upon the desired pump usage percentage.

The control also preferably includes an input which provides the present voltage ($V_b$) of the electrical system, and the PCSG determines the pulse width modulated duty cycle percentage control signal based upon the pump usage percentage, the voltage, and a calibrated fixed frequency.

The Pressure Commander determines a desired pressure $PR_{DES}$ based upon current engine speed and torque, preferably from a three-dimensional look-up table, and computes a pressure deviation $PR_{ERR}$, which is the difference between $PR_{DES}$ and $PR_{ACT}$.

The Pump Usage Governor may employ conventional proportional-integral (PI) control logic to develop a proportional factor (P) and, preferably, an integrating factor (I) based upon the pressure deviation supplied by the Pressure Commander, as well as logic for developing a feed forward factor ($ff_{PROP}$) based upon torque. The pump usage percentage, $P_{UT}$%, is then preferably developed as a function of each of the proportional, integral, and feed forward factors, and, most preferably, is a summation of those factors.

The above objects and other objects, features, and advantages of the present invention, will be readily appreciated by one of ordinary skill in the art from the following detailed description of the best mode for carrying out the invention when taken in connection with the accompanying drawings.

BEST MODE FOR CARRYING OUT THE INVENTION

Figure 1:
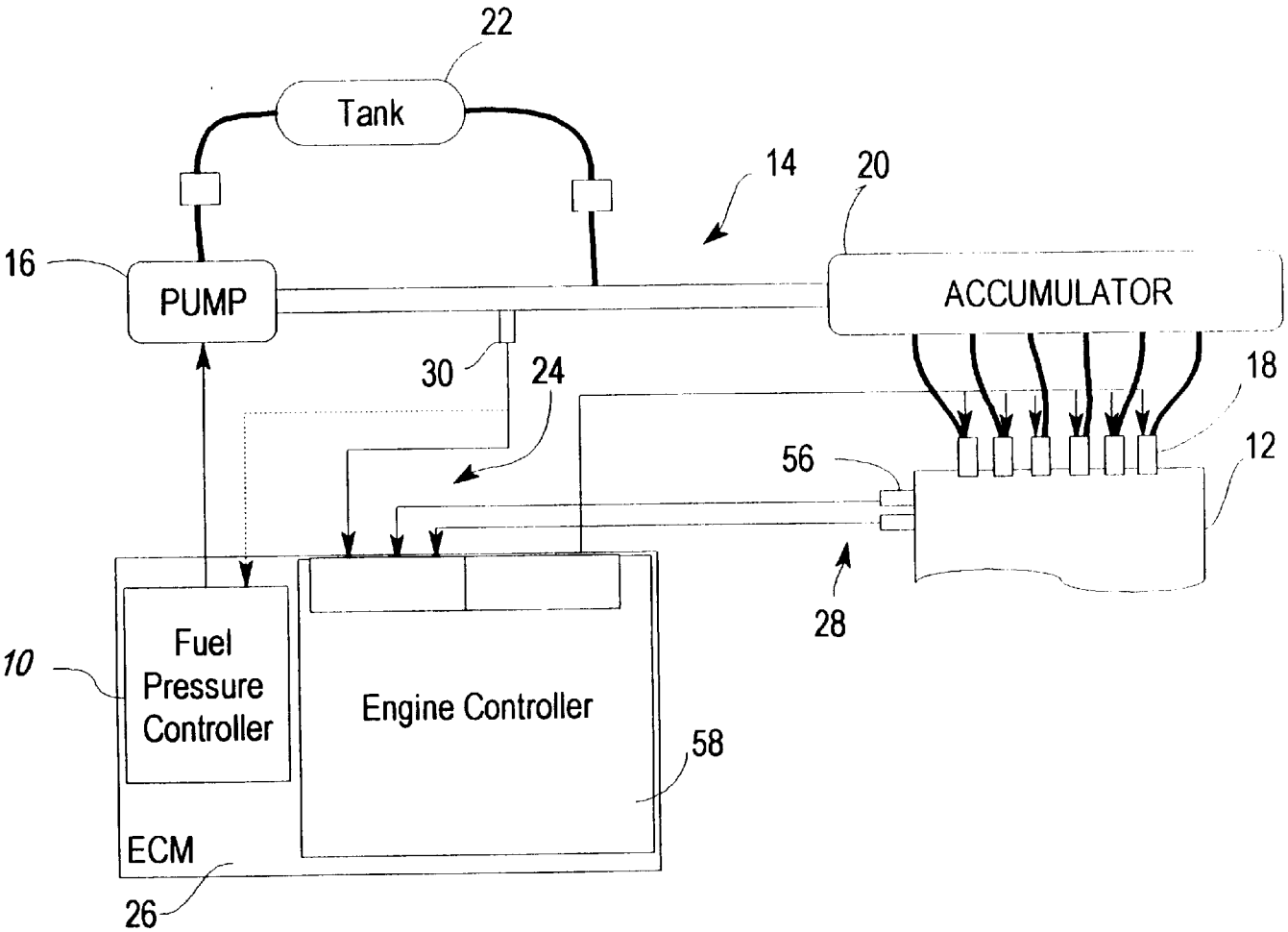
FIG. 1 is a block diagram of the fuel pressure controller of the present invention implemented as part of an integrated comprehensive engine control system for a compression-ignition internal combustion engine employing a common rail fuel injection system.

Referring now to FIG. 1, a block diagram of the fuel pressure control system and method of the present invention is shown. The system 10 is particularly suited for use in a vehicle (not shown) which includes an engine 12 which employs a common rail fuel injection system, generally designated as 14. The engine is typically a compression-ignition internal combustion engine, typically a diesel engine having up to 16 cylinders. The fuel injectors 18 are typically electronically and/or hydraulically controlled unit injectors, such as injector assembly Part Number 0000105151, available from Detroit Diesel corporation. The common rail fuel injection system includes at least one high pressure fuel pump 16, a plurality of fuel injectors 18, and a common rail (also known and referred to herein as an accumulator) 20 connected between the fuel pump 16 and the injectors 18 to accumulate fuel at a desired, relatively high pressure from the pump for injection into the engine cylinders as required (and as controlled by another control function within the Engine Controller 58). The fuel system also typically includes a fuel supply tank 22 connected to the high pressure pump 16. A plurality of sensors 24, typically including engine sensors 28 and common rail pressure sensor 30, are in electrical communication with the controller 26 via input ports 32.

Figure 2:
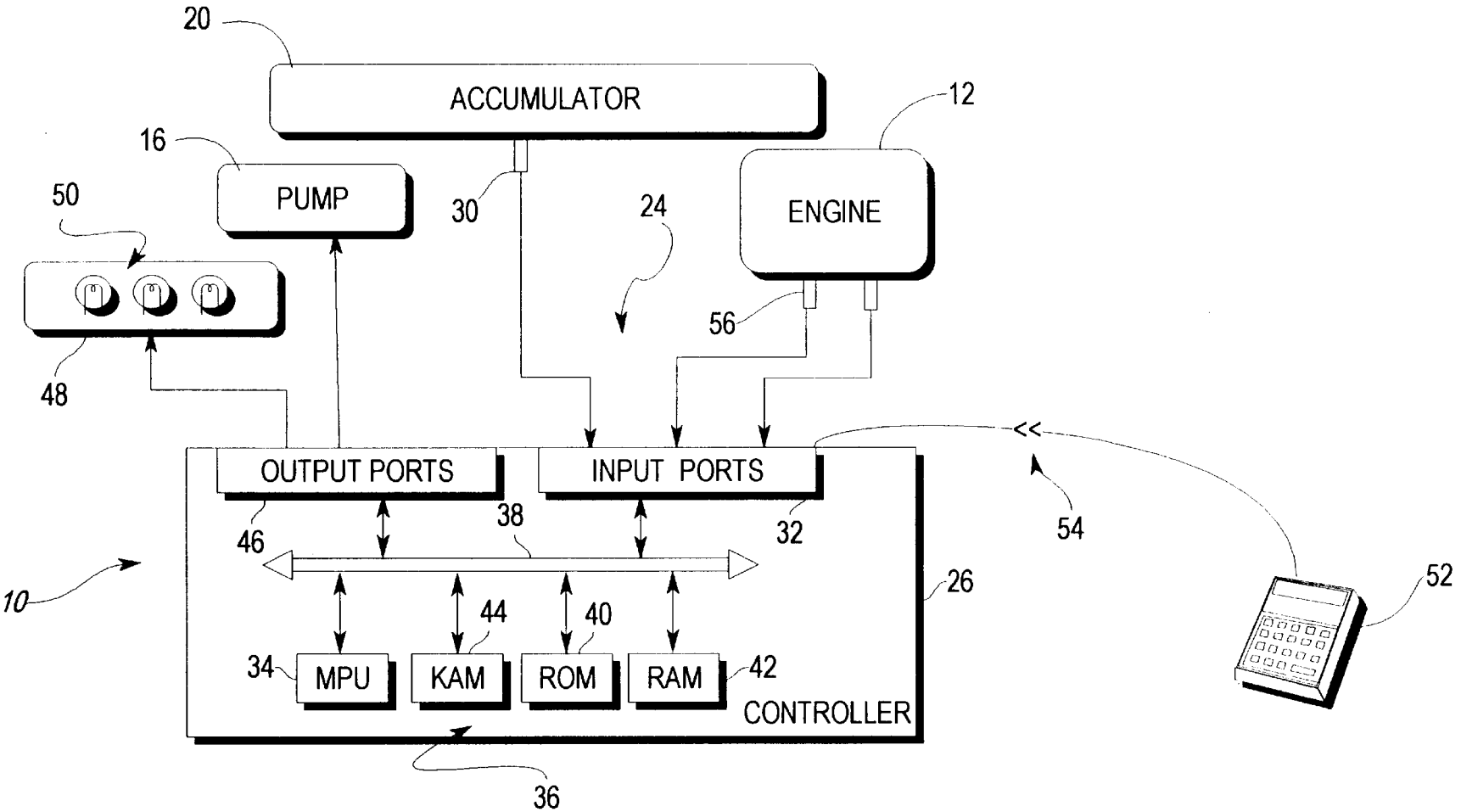
FIG. 2 is a block diagram illustrating the basic hardware architecture of an embodiment of the controller of the present invention.

As illustrated in FIG. 2, controller 26 preferably includes a microprocessor 34 in communication with various computer-readable storage media 36 via data and control buffers 38. Computer-readable storage media 36 may include any of the number of known devices which function as read-only memory (ROM) 40, random access memory (RAM) 42, keep-alive memory (KAM) 44, and the like. The computer-readable storage media may be implemented by any of a number of known physical devices capable of storing data representing instructions executable via a computer such as controller 26. Known devices may include but are not limited to PROMs, EPROMs, EEPROMs, flash memory, and the like, in addition to magnetic, optical and combination media capable of temporary or permanent data storage.

Computer-readable storage media 36 include various program instructions, software, and control logic to affect control of various systems and sub-systems of the vehicle, such as the engine 12, transmission (not shown), and the like. The controller 26 receives signals from sensors 24 via input ports 32 and generates output signals which may be provided to various actuators and/or components via output ports 46.

Signals may also be provided to a display device 48 which includes various indicators such as lights 50 to communicate information relative to system operation to the operator of the vehicle. Display 48 may also include an alpha-numeric portion or other suitable operator interface to provide status information to a vehicle operator or a technician. As such, display 48 represents one or more displays or indicators which may be located throughout the vehicle interior and exterior, but is preferably located in the cab or interior of the vehicle.

A data, diagnostics, and programming interface 52 may also be selectively connected to the controller 26 via a plug 54 to exchange various information therebetween. Interface 52 may be used to change values within the computer-readable storage media 48, such as configuration settings, calibration variables, control logic and the like.

The sensors 24 preferably include an engine speed sensor 56. Engine speed may be detected using any of a number of known sensors which provide signals indicative of rotational speed for the flywheel, or various internal engine components such as the crankshaft, camshaft or the like. In a preferred embodiment, engine speed is determined using a timing reference signal generated by a multi-tooth wheel coupled to the camshaft. A pressure sensor 30 is preferably provided to determine the actual fuel pressure within the accumulator 20. As will be appreciated by one of ordinary skill in the art, most vehicle applications will neither require nor utilize all of the sensors illustrated in FIGS. 1 and 2. As such, it will be appreciated that the objects, features and advantages of the present invention are independent of the particular manner in which the operating parameters are sensed.

In operation, controller 26 receives signals from sensors and executes control logic embedded in hardware and/or software to monitor the actual fuel pressure within the accumulator 20 of the fuel injection system, compute a pressure deviation as a result of a desired pressure input to the fuel pressure controller 10 by the engine controller 58, and generate a control signal to drive the variable output fuel pump 16 to deliver the desired fuel quantity to maintain the desired system fuel pressure. It should be noted that while the fuel pressure controller 10 is shown in the illustrated embodiment of FIG. 1 to be a separate functional entity from the engine controller 58, and is preferred to operate in a logically separate manner from the engine controller control logic, the control logic for the fuel pressure controller 10 may be integrated with the engine control logic, or other vehicle control logic, as desired without departing from the spirit of the invention. In a preferred embodiment, controller 26 is a DDEC controller available from Detroit Diesel Corporation in Detroit, Mich. Various other features of this controller are described in detail in U.S. Pat. Nos. 5,477,827 and 5,445,128, the disclosures of which are hereby incorporated by reference in their entirety.

Figure 3:
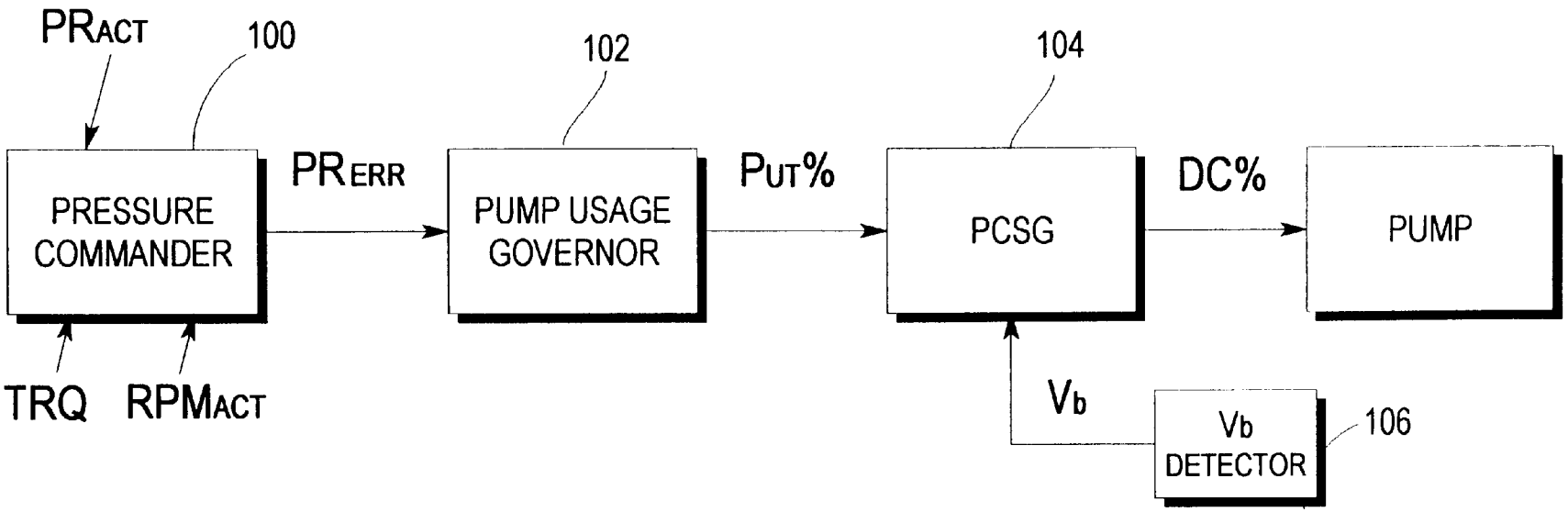
FIG. 3 is a block diagram of the fuel pressure control system of the present invention.
Figure 4:
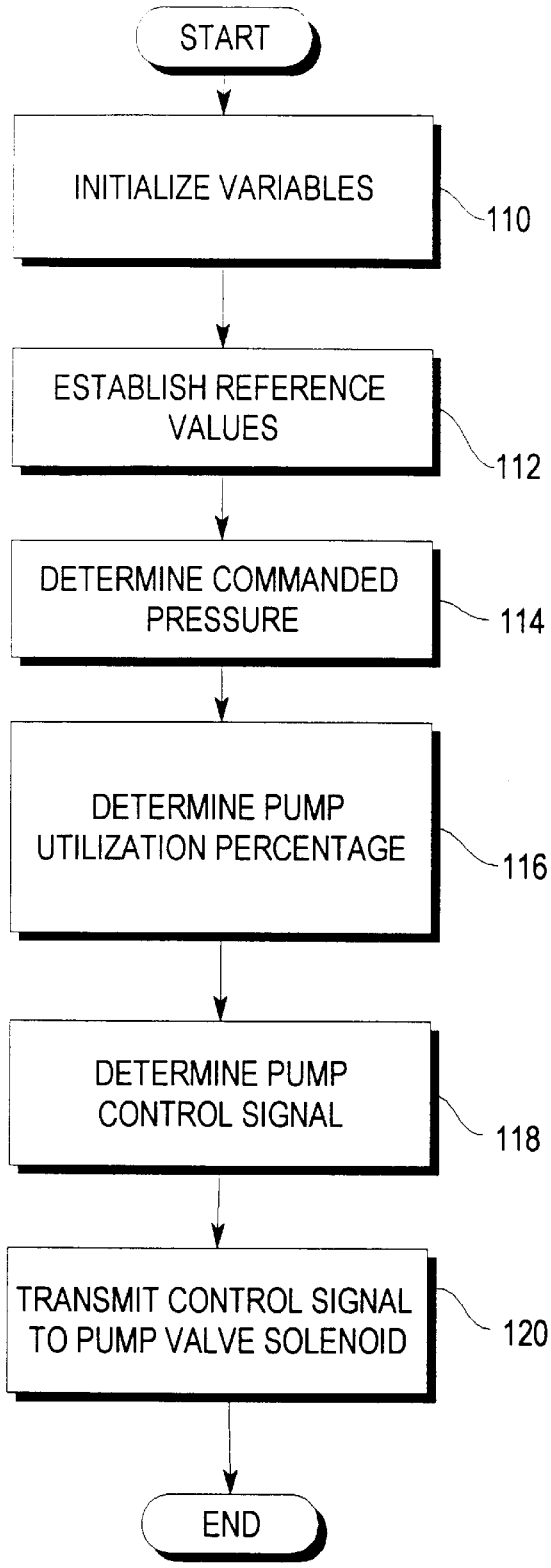
FIG. 4 is a flow chart illustrating the method of the present invention for controlling a variable displacement high pressure pump, and, thereby, controlling the common rail system fuel pressure.

Referring now to FIGS. 3 and 4, a block diagram and flow chart, respectively, illustrating representative control logic of a system and method for monitoring and controlling the fuel pressure in the accumulator of a common rail fuel injection system according to the present invention are shown. Again, it will be appreciated that the control logic may be implemented or effected in hardware, software, or a combination of hardware and software. The various functions are preferably effected by a programmed microprocessor, such as the DDEC III controller, but may include one or more functions implemented by dedicated electric, electronic, and integrated circuits. As will also be appreciated, the control logic may be implemented using any of a number of known programming and processing techniques or strategies and is not limited to the order or sequence illustrated here for convenience only. For example, interrupt or event-driven processing is typically employed in real-time control applications, such as control of a vehicle engine or transmission. Likewise, parallel processing or multi-tasking systems and methods may be used to accomplish the objects, features, and advantages of the present invention. The present invention is independent of the particular programming language, operating system, or processor used to implement the illustrated control logic.

Block 100 of FIG. 3 illustrates the Pressure Commander which receives actual pressure ($PR_{ACT}$) from pressure sensor 30, as well as engine RPM (either directly from an RPM sensor, or indirectly from the engine controller 58), and torque, TRQ, preferably generated and downloaded from the engine controller 58. The Pressure Commander determines a desired pressure ($PR_{DES}$) based upon RPM and TRQ. The $PR_{DES}$ is then compared to $PR_{ACT}$ and a pressure deviation ($PR_{ERR}$) is determined based upon that comparison. $PR_{ERR}$ is preferably the difference between $PR_{DES}$ and $PR_{ACT}$.

The Pump Usage Governor, shown as block 102, receives $PR_{ERR}$ as an input, as well as inputs indicative of pressure sensor fault conditions and engine operating status (such as start-up and shut off) to determine the pump utilization percentage, $P_{UT}\%$ . In one embodiment, a proportional-integral controller is utilized by the Pump Usage Governor to develop a proportional factor (P) which adjusts the $P_{UT}\%$ by an amount proportional to $PR_{ERR}$, an integrating factor (I) which adjusts the $P_{UT}\%$ by an amount equal to the accumulated multiplication of $PR_{ERR}$ and time, and a forward factor ($ff_{PROP}$) which adjusts the $P_{UT}\%$ by an amount proportional to the engine torque. In one embodiment, $P_{UT}\%$ is a simple summation of each of the P, I, and $ff_{PROP}$ factors. P is preferably set at 0.19% UTIL/BAR, I is set at 0.043%UTIL/BAR/TIME INTERVAL (at 16 mHz), and $ff_{PROP}$ is set 2.25%UTIL/%MAX TORQUE. Of course, these factors are dependent upon the behavioral characteristics of the engine and common rail system. It has been found that the proportional gain constant P, will typically range between 0–0.125%UTIL/BAR, the integrating constant, I, will typically range between 0–0.006%UTIL/BAR/TIME INTERVAL (at 16 mHz), and the feed forward factor constant, $ff_{PROP}$, will typically range between 0–1.25%UTIL/%/MAX TORQUE. $ff_{PROP}$ is typically initialized at about 50% of the normal working range of the pump.

The integrating factor is preferably determined at time intervals of approximately 25 msec, although, again, the rate of integration may be varied depending upon particular system response characteristics.

The feed forward factor may additionally or alternatively be based upon one or more other engine operation parameters that vary proportionally to the quantity of fuel injected.

It will be appreciated that the Pump Usage Governor may calculate the pump utilization percentage using a proportional factor, or an integrating factor, or a feed forward factor, either alone or in some combination. Other factors developed from historical system operation data, current operating conditions and/or predictive schemes may be employed other than the above-described embodiment as desired, or as required by the particular behavioral characteristics of the particular engine, high-pressure fuel pump and common rail fuel injection system with which the control is employed.

In the embodiment illustrated in FIG. 3, $P_{UT}\%$ is developed by simple addition of each of the P, I, and $ff_{PROP}$ factors. This particular method has been found to provide a $P_{UT}\%$ value which maintains desired fuel system pressure based upon historical, current, and expected engine operation conditions with minimal pressure fluctuations.

Block 104 illustrates the PCSG. The PCSG receives $P_{UT}\%$ and, preferably, present electrical system voltage ($V_b$) as inputs, and develops a control signal from those inputs suitable to control the variable output high pressure fuel pump. In one embodiment, the fuel pump is a variable displacement fuel pump including a solenoid-actuated control valve, wherein the displacement and, therefore, the fuel output of the pump, is inversely proportional to the current applied to the solenoid. In this embodiment, the pump is Assemby Part No. 0050706501, available from Detroit Diesel Corporation of Detroit, Mich. The control signal which drives the solenoid which actuates the pump control valve is a pulse-width modulated signal representing the duty cycle percentage (DC%) required to power the solenoid at a fixed frequency. In this embodiment, the control valve is fully opened (i.e., 100% pump output utilization) when DC% equals a relatively lesser, calibratable value (approaching zero) (i.e., the solenoid is not energized), and the pump utilization percentage is zero when DC% equals a relatively greater, calibratable value (approaching 100) (i.e., the solenoid is fully energized), the control valve is closed, and, therefore, the pump is not supplying any additional fuel to the common rail system.

The PCSG 104 also preferably employs a present voltage calibration factor in its determination of the DC% control signal. A $V_b$ detector 106 (also schematically illustrated in FIG. 5) supplies the present voltage Vb as an input to the PCSG. The DC% signal is determined as a function of $V_b$ to eliminate the effect of fluctuations in system voltage upon the operation of the solenoid and, therefore, eliminate the effect of system voltage fluctuations on the output of the fuel pump. In one embodiment, DC% is determined by interpolating between a pair of curves representing 0% pump utilization and 100% pump utilization, respectively, for each of the possible values of $V_b$. This method is illustrated in FIG. 6. This determination can be expressed as:

$$DC\% = \left[P_{UT}\% \cdot \left(\frac{K_1}{Vb} - \frac{K_2}{Vb}\right)\right] + \frac{K_2}{Vb}$$

where $K_1$ and $K_2$ are constants relating to the response characteristics of the particular fuel pump and solenoid actuator employed in the system.

Thus, for example, if $P_{UT}\%$ input to the transfer function is 40 (i.e., the desired pump utilization percentage is 40%) and the present voltage is $V_I$, DC% (equal to $DC_I$) is determined by interpolating between points P1 and P2 as 40% of the difference between the DC values between these points. In one embodiment, the constant value of the upper curve (0% pump utilization) is 600 DC%*volts, and the constant value of the lower curve (100% pump utilization) equals 150 DC%*volts. Thus, in this embodiment, the DC% is percentage is determined as follows:

$$DC\% = \left[P_{UT}\% \cdot \left(\frac{150}{Vb} - \frac{600}{Vb}\right)\right] + \frac{600}{Vb}$$

Once determined, the pulse-width modulated signal corresponding to DC% is then transmitted to drive the solenoid to achieve the desired control valve opening and, thereby, achieve the desired displacement of the pump to maintain the pressure in the accumulator at the desired level.

Referring again to FIG. 4, a flow diagram illustrating the method of the present invention is shown. Block 110 represents initialization of various programming variables and thresholds, one or more of which may be determined during initialization or reprogramming of the system. Other values may be retrieved from a non-volatile memory or a computer-readable storage media upon engine start-up or other events such as a detection of a fault or error. These values preferably include the RPM, TRQ, and $PR_{DES}$ look up map employed by the Pressure Commander, the constants for the P, I, and $ff_{PROP}$ factors employed by the Pump Usage Governor, as well as pressure thresholds, also employed by the Pump Usage Governor to detect fault conditions. In addition, the initial pump utilization value, as well as required engine start and stop conditions (determined by the Engine Control Logic), each also preferably utilized by the Pump Usage Governor as explained hereinafter, are also initialized at this time. Other reference values preferably include the DC% constants $K_1$ and $K_2$ for each of the 0% and 100% pump utilization curves employed by the Pump Control Signal Generator.

Reference values preferably include engine speed, RPM; torque, actual rail pressure, $PR_{ACT}$; and present voltage, $V_b$. The RPM and torque values may be communicated by an engine controller, such as illustrated in FIG. 1. $PR_{ACT}$ may also be communicated from the engine controller, or may be input directly from the pressure sensor attached to the accumulator. One of ordinary skill in the art will recognize a number of methods to determine engine RPM which may be directly sensed or indirectly inferred from various other sense parameters, as well as torque which may be likewise inferred from other sensed parameters. The reference values determined by block 112 are periodically reset or captured (and stored) based on the occurrence of one or more predetermined events.

The pressure deviation, $PR_{ERR}$ is determined at block 114. As previously described, this value is preferably generated as the difference between $PR_{DES}$ and $PR_{ACT}$, $PR_{DES}$ is developed from RPM and TRQ inputs, preferably by reference to a look-up table which has been initialized in block 110. The selection of $PR_{DES}$ is preferably effected by using a look up table which maps $PR_{DES}$ as a function of RPM and torque percentage. One such table which might be employed for the specific embodiment disclosed in this application is listed below:

| RPM | | 150 | 300 | 450 | 600 | 750 | 900 | 1050 | 1200 |
|---|---|---|---|---|---|---|---|---|---|
| % TORQUE | 0.0 | 325 | 462 | 600 | 600 | 600 | 616 | 633 | 650 |
| | 12.5 | 325 | 462 | 600 | 600 | 600 | 616 | 633 | 650 |
| | 25.0 | 325 | 462 | 600 | 675 | 725 | 741 | 762 | 755 |
| | 37.5 | 325 | 462 | 600 | 750 | 850 | 866 | 891 | 860 |
| | 50.0 | 325 | 462 | 600 | 825 | 975 | 991 | 1020 | 965 |
| | 62.5 | 325 | 462 | 600 | 825 | 975 | 1116 | 1150 | 1070 |
| | 75.0 | 325 | 462 | 600 | 825 | 975 | 1116 | 1150 | 1175 |
| | 87.5 | 325 | 462 | 600 | 825 | 975 | 1116 | 1150 | 1175 |
| | 100.0 | 325 | 462 | 600 | 825 | 975 | 1116 | 1150 | 1175 |
| RPM | | 1350 | 1500 | 1650 | 1800 | 1950 | 2100 | 2250 | 2400 |
| % TORQUE | 0.0 | 666 | 683 | 700 | 700 | 700 | 700 | 700 | 0 |
| | 12.5 | 666 | 633 | 700 | 700 | 700 | 700 | 700 | 0 |
| | 25.0 | 666 | 683 | 700 | 800 | 800 | 800 | 800 | 0 |
| | 37.5 | 773 | 786 | 825 | 900 | 900 | 900 | 900 | 0 |
| | 50.0 | 880 | 890 | 950 | 1000 | 1000 | 1000 | 1000 | 0 |
| | 62.5 | 986 | 993 | 1075 | 1100 | 1100 | 1100 | 1100 | 0 |
| | 75.0 | 1093 | 1096 | 1200 | 1200 | 1200 | 1200 | 1200 | 0 |
| | 87.5 | 1200 | 1200 | 1200 | 1200 | 1200 | 1200 | 1200 | 0 |
| | 100.0 | 1200 | 1200 | 1200 | 1200 | 1200 | 1200 | 1200 | 0 |

$P_{UT}$% is determined at block 116, based upon $PR_{ERR}$. As previously described, a proportional factor and an integrating factor are each developed as a function of $PR_{ERR}$, and a feed forward factor is developed based upon current torque. Again, $P_{UT}$% is preferably a simple summation of the P, I, and ff factors.

Figure 5:
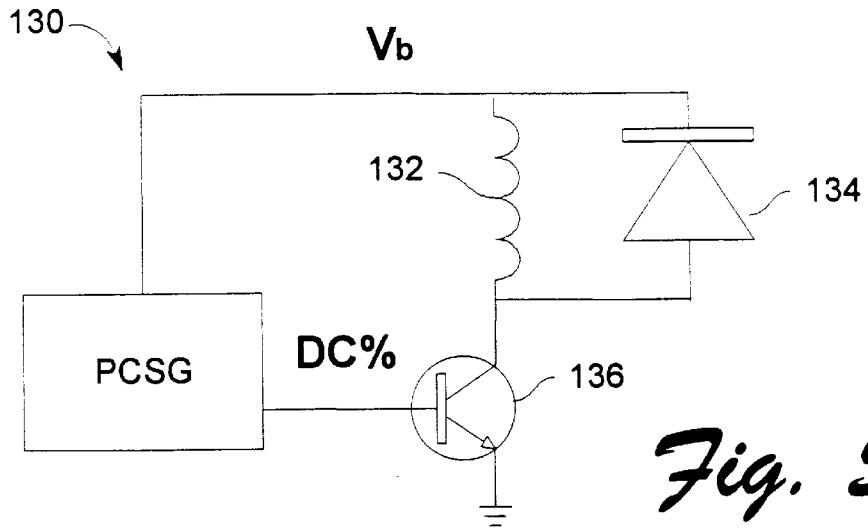
FIG. 5 is a block/schematic diagram of the PCSG including electrical system voltage feedback; and, FIG. 6 is a graph of a transfer function employed in the present invention in determining the pulse width modulated DC% signal output to the pump valve solenoid.
Figure 6:
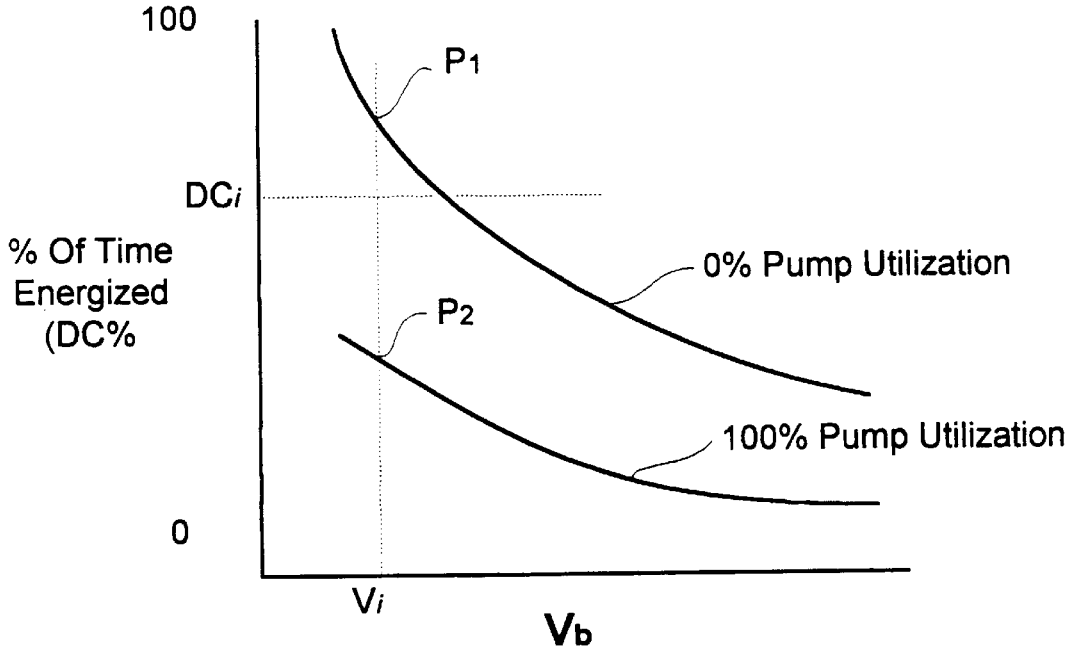

FIG. 5 is a schematic illustration of the circuit employed by the PCSG to measure present voltage. The circuit 130 typically includes an actuator solenoid 132, a diode 134 and a transistor 136 connected as illustrated within the electrical system to provide an input signal to the PCSG corresponding to the present system voltage, so that the PCSG can factor the fluctuations in voltage into its determination of the DC% signal output to the pump. It will be appreciated that other conventional methods of ascertaining present voltage may be alternatively utilized to supply $V_b$ to the PCSG.

Referring now to FIG. 6, the pump control signal, DC%, is determined at block 118, based upon the $P_{UT}$% and present voltage, $V_b$, inputs. Again, this pulse-width modulated signal preferably represents a duty cycle 90, is transmitted at 100 Hz, and is determined by interpolating between points on a pair of curves representing 0% pump utilization and 100% pump utilization at the present $V_b$. It will be appreciated that as previously described, the constants $K_1$ and $K_2$, as well as the signal frequency are chosen, and may vary, depending upon the particular operating characteristics of the solenoid controlled injector valve.

Various fault conditions are preferably monitored by the system and factored into control of the pump. For example, inputs to the Pump Usage Governor 102 preferably include a maximum pump utilization value (max_pump_util), a minimum pump utilization value (min_pump_util) and a pump utilization fault timer value (pump_util_fault_timer). In one embodiment, the Pump Usage Governor receives the pump utilization maximum and minimum values as inputs, and compares $P_{UT}$% to these maximum and minimum values. If, for example, $P_U$% is greater than the maximum pump utilization value for a time greater than the pump utilization fault time a fault condition (e.g., the valve is stuck closed, or fuel is leaking) is assumed and a warning indicator is activated and the event is recorded. Likewise, if $P_{UT}$% is less than the minimum pump utilization value for a time greater than the pump utilization fault time a fault condition (e.g., the valve is stuck open or is not energizing) is assumed and a warning indicator is activated and the event is recorded. The pump utilization fault time is typically set to between 0 and 255 seconds, and is preferably set at 10 seconds. The minimum pump utilization value is preferably set at about 2.5%, and the maximum pump utilization value is preferably set at 97.5%.

In one embodiment when the engine is determined to be in start-up condition, the system forces an output of $P_{UT}$% equal to about 100% until $PR_{ERR}$ is about equal to zero. When $PR_{ERR}$ reaches zero, then the integrating factor, I, is initialized to an initial pump utilization value, typically about 50%UTIL/BAR, minus the feed forward factor, $ff_{PROP}$, and the system begins normal generation of $P_{UT}$% as described above.

$P_{UT}$% may be displayed continuously on a diagnostic tool to indicate the status of the control system's calibration, and the general condition of the high pressure fuel system, as well as an indicator of hidden internal leaks, malfunction, or wear of the pump components.

Thus, the present invention provides a system and method for monitoring and controlling the fuel pressure within a common rail fuel injection system which relies on minimal inputs from the fuel injection system, the engine, and other controllers, preferably only ($PR_{ACT}$, RPM, TRQ, and $V_b$), but which provides accurate and smooth closed-loop control of the fuel pressure at all of the various and changing demands of a typical fuel injection engine.

While the best mode contemplated for carrying out the invention has been described in detail, those familiar with the art to which this invention relates will recognize various alternative designs and embodiments for practicing the invention as defined by the following claims.

What is claimed is:

1. In a common rail fuel injection system including a plurality of fuel injectors for injecting fuel at a selected pressure from a common rail into the cylinders of an internal combustion engine, a common rail connected to the injectors for accumulating fuel at the selected pressure, a variable output fuel pump connected to the common rail, the pump including a solenoid-actuated valve for controlling the fuel input to the pump, and an electronic engine control for providing a plurality of inputs corresponding to engine operating conditions, an electronic fuel pressure control comprising:

a sensor for sensing the actual rail pressure;

a pressure commander including logic for determining a pressure deviation based upon the sensed actual pressure and engine operation conditions;

a pump output governor including logic for determining the pump usage percentage as a function of the pressure deviation; and a pump control signal generator including logic for determining a control signal based upon the pump usage percentage, and logic for outputting that signal to power the pump solenoid.

2. The electronic fuel pressure control of claim 1 further including a sensor connected to the control for sensing the present voltage in the electrical system, and wherein the pump control signal generator includes logic for determining the control signal based upon the pump usage percentage and the present voltage.

3. The electronic fuel pressure control of claim 1 wherein the logic for determining the pressure deviation includes logic for determining a desired pressure based upon engine speed and engine torque values input from the engine control and wherein the pressure deviation is the difference between the desired pressure and the actual pressure.

4. The electronic fuel pressure control of claim 1 wherein the pump usage governor logic employs proportional control logic and wherein the pump usage percentage is determined as a function of a proportional factor.

5. The electronic fuel pressure control of claim 4 wherein the pump usage command logic employs integrating control logic and wherein the pump usage percentage is determined as a function of the proportional factor and an integrating factor.

6. The electronic fuel pressure control of claim 5 wherein the output governor includes logic for determining a feed forward factor based upon an engine operating parameter that is proportional to fuel injection quantity, and wherein the pump usage percentage is determined as a function of the proportional factor, the integrating factor, and the feed forward factor.

7. The electronic fuel pressure control of claim 6 wherein the pump usage percentage is a summation of the proportional factor, the integrating factor, and the feed forward factor.

8. The electronic fuel pressure control of claim 6 wherein the feed forward factor is based upon engine torque.

9. The electronic fuel pressure control of claim 2 wherein $$DC\% = \left[P_{UT}\% \cdot \left(\frac{K_1}{Vb} - \frac{K_2}{Vb}\right)\right] + \frac{K_2}{Vb}.$$

10. A method of controlling the fuel pressure in the high pressure accumulator of a common rail fuel injection system having at least one variable displacement fuel pump including a solenoid actuated control valve, the method comprising:

determining an engine speed and an engine torque;

sensing an actual pressure in the accumulator;

determining a desired pressure based upon the engine speed and the engine torque;

determining a pressure deviation based on the desired pressure and the actual pressure;

determining a pump utilization percentage based on the pressure deviation; and controlling the fuel pump based upon the pump utilization percentage.

11. The method of claim 10 wherein determining the pump utilization percentage includes determining a proportional factor.

12. The method of claim 11 wherein determining the pump utilization percentage includes determining an integral factor.

13. The method of claim 11 wherein determining the pump utilization percentage includes determining a feed forward factor.

14. The method of claim 10 wherein determining the pump utilization percentage includes determining a proportional factor, an integral factor, and a feed forward factor.

15. The method of claim 14 wherein the pump utilization percentage is a summation of the proportional factor, the integral factor, and the feed forward factor.

16. A method for controlling the fuel pressure in a common rail fuel injection system for an engine having at least one variable displacement fuel pump including a solenoid actuated control valve, and a plurality of sensors for sensing vehicle operating parameters, the method comprising:

determining the actual fuel pressure in the accumulator;

determining the engine speed and desired torque;

determining a fuel pressure deviation based upon the actual fuel pressure and the engine speed and torque;

determining a pump utilization percentage based upon the fuel pressure deviation; and determining a pump control signal based upon the pump utilization percentage.

17. The method of claim 10 further comprising:

determining an available voltage in a vehicle electrical system, wherein the fuel pump is controlled based on the pump utilization percentage and the available voltage.

18. The method of claim 16 further comprising:

determining an available voltage in a vehicle electrical system, wherein the fuel pump is controlled based on the pump utilization percentage and the available voltage.

* * * * *